US011289024B2

(12) United States Patent
Kim et al.

(10) Patent No.: US 11,289,024 B2
(45) Date of Patent: Mar. 29, 2022

(54) DISPLAY DEVICE

(71) Applicant: LG Display Co., Ltd., Seoul (KR)

(72) Inventors: Kyujin Kim, Paju-si (KR); Taehun Kim, Paju-si (KR); Donggun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 7 days.

(21) Appl. No.: 16/921,274

(22) Filed: Jul. 6, 2020

(65) Prior Publication Data

US 2021/0027712 A1 Jan. 28, 2021

(30) Foreign Application Priority Data

Jul. 25, 2019 (KR) ..... 10-2019-0090355

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01)

(58) Field of Classification Search
CPC ... G09G 2320/0261; G09G 2320/0252; G09G 2340/0435; G09G 2340/16; G09G 2300/0842; G09G 2300/0852; G09G 2330/021; G09G 3/3659; G09G 2310/0251
See application file for complete search history.

(56) References Cited

U.S. PATENT DOCUMENTS 6,229,506 B1 * 5/2001 Dawson ..... G09G 3/3233 345/82
7,750,875 B2 7/2010 Kim et al.
10,504,442 B2 12/2019 Yoo
(Continued)

FOREIGN PATENT DOCUMENTS

JP 2009-193063 A 8/2009
JP 2019-012258 A 1/2019
(Continued)

OTHER PUBLICATIONS

Japan Patent Office, Office Action, JP Patent Application No. 2020-119632, dated Apr. 27, 2021, eight pages.
(Continued)

*Primary Examiner* — Dong Hui Liang
(74) *Attorney, Agent, or Firm* — Fenwick & West LLP

(57) ABSTRACT

A display device includes: a display panel provided with multiple pixels; a driving circuit; and a power generator, wherein each of the pixels includes: a first switching transistor of which a gate electrode is connected to the gate line, of which a first electrode is connected to the data line, and of which a second electrode is connected to a first node; a driving transistor of which a gate electrode is connected to a reference line and thus receives a reference voltage supplied from the power generator, of which a first electrode is connected to the first node, and of which a second electrode is connected to a second node; and a light-emitting device of which an anode electrode is connected to the second node, and of which a cathode electrode is connected to a power line through which the power generator supplies a low-potential power supply voltage.

11 Claims, 14 Drawing Sheets

(56) References Cited

U.S. PATENT DOCUMENTS

| | | | | |
|---|---|---|---|---|
| 2007/0296672 | A1 | 12/2007 | Kim et al. | |
| 2008/0259064 | A1* | 10/2008 | Chiou | G09G 3/3233 345/205 |
| 2009/0179833 | A1 | 7/2009 | Honda | |
| 2012/0223874 | A1 | 9/2012 | Honda | |
| 2015/0035448 | A1* | 2/2015 | Wang | G09G 3/3291 315/240 |
| 2015/0054812 | A1* | 2/2015 | Jeon | G09G 3/3233 345/212 |
| 2015/0279274 | A1* | 10/2015 | Pyo | G09G 3/3233 345/77 |
| 2015/0325169 | A1* | 11/2015 | Qing | G09G 3/3233 345/214 |
| 2017/0169761 | A1* | 6/2017 | Ma | H01L 27/3276 |
| 2019/0005884 | A1 | 1/2019 | Yoo | |
| 2019/0371236 | A1* | 12/2019 | Sakai | G09G 3/3233 |
| 2019/0385520 | A1* | 12/2019 | Chen | G09G 3/3266 |

FOREIGN PATENT DOCUMENTS

| | | | |
|---|---|---|---|
| KR | 10-2007-0121466 | A | 12/2007 |
| WO | WO 2018/173244 | A1 | 9/2018 |
| WO | WO 2019/024395 | A1 | 2/2019 |

OTHER PUBLICATIONS

China National Intellectual Property Administration, Office Action, CN Patent Application No. 202010652204.9, dated Jan. 17, 2022, 12 pages.

* cited by examiner

DISPLAY DEVICE

CROSS-REFERENCE TO RELATED APPLICATIONS

This application claims the benefit of Republic of Korea Patent Application No. 10-2019-0090355 filed on Jul. 25, 2019, which is incorporated by reference in its entirety.

BACKGROUND

Field of Technology

The present disclosure relates to a display device. More particularly, the present disclosure relates to an organic light-emitting pixel structure capable of impulse driving.

Discussion of the Related Art

Virtual reality technology has been rapidly developed in various fields, such as multimedia, games, movies, architecture, tourism, national defense, and the like. Virtual reality refers to a particular environment or situation that is felt similar to the actual environment by using a stereoscopic image technology. Devices for realizing the virtual reality technology may be divided into virtual reality (VR) devices and augmented reality (AR) devices.

In a VR display device, for a user's immersion, an image is enlarged through the lens and provided at a position very close to the user's eye. Therefore, an ultra-high-definition display panel with extremely high pixels per inch (ppi) needs to be used so that the size of the display device is small and the user is unable to recognize the pixels.

In addition, when the user uses the VR display device for a long time, the user feels motion sickness or fatigue (VR sickness). In order to reduce such fatigue, a display panel with a high response rate needs to be employed.

An organic light-emitting display panel of an active matrix type, which includes an organic light-emitting diode (OLED) that is self-luminous, has a high response rate, great luminous efficiency, great luminance, and great viewing angle, and has been used increasingly for numerous VR display devices.

However, the organic light-emitting display panel maintains data in each pixel and then emits light sequentially or simultaneously. Therefore, there is a limit in increasing the response rate (MPRT). In addition, if a new scan method is employed to increase the response rate, the pixel structure becomes complex so there is a limit in increasing the resolution or luminance.

SUMMARY

Accordingly, the present disclosure has been made keeping in mind the above problems occurring in the related art, and the present disclosure is intended to provide a pixel circuit with a high response rate and a simple structure.

According to an embodiment, there is provided a display device including: a display panel provided with multiple pixels; a driving circuit driving the display panel by supplying a scan signal to horizontal lines sequentially, starting from a first horizontal line to the last horizontal line, through multiple gate lines each connected to the pixels in each of the horizontal lines of the display panel, in synchronization with supply of a data voltage through multiple data lines; and a power generator supplying an operating voltage to the display panel.

Each of the pixels includes: a first switching transistor of which a gate electrode is connected to the gate line, of which a first electrode is connected to the data line, and of which a second electrode is connected to a first node; a driving transistor of which a gate electrode is connected to a reference line and thus receives a reference voltage supplied from the power generator, of which a first electrode is connected to the first node, and of which a second electrode is connected to a second node; and a light-emitting device of which an anode electrode is connected to the second node, and of which a cathode electrode is connected to a power line through which the power generator supplies a low-potential power supply voltage.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
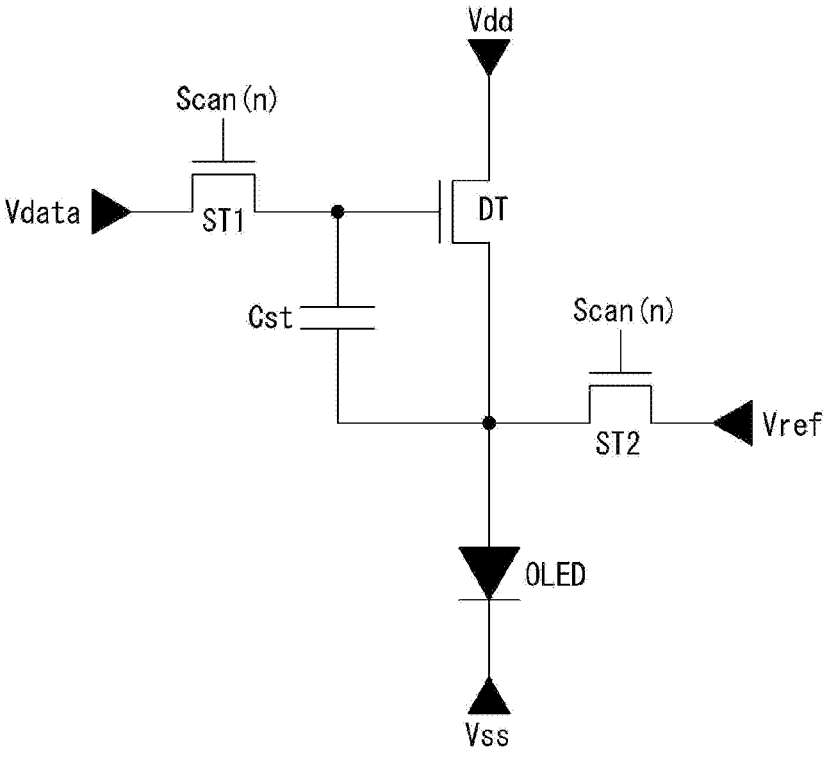
FIG. 1 is a diagram showing an OLED pixel circuit composed of three transistors and one capacitor according to one embodiment.

Hereinafter, preferred embodiments of the present disclosure will be described in detail with reference to the accompanying drawings. Throughout the specification, the same reference numerals denote the substantially same elements. In the following description, when it is determined that a detailed description of known functions or configurations related with the present disclosure may make the gist of the present disclosure unclear, the detailed description thereof will be omitted.

Figure 2:
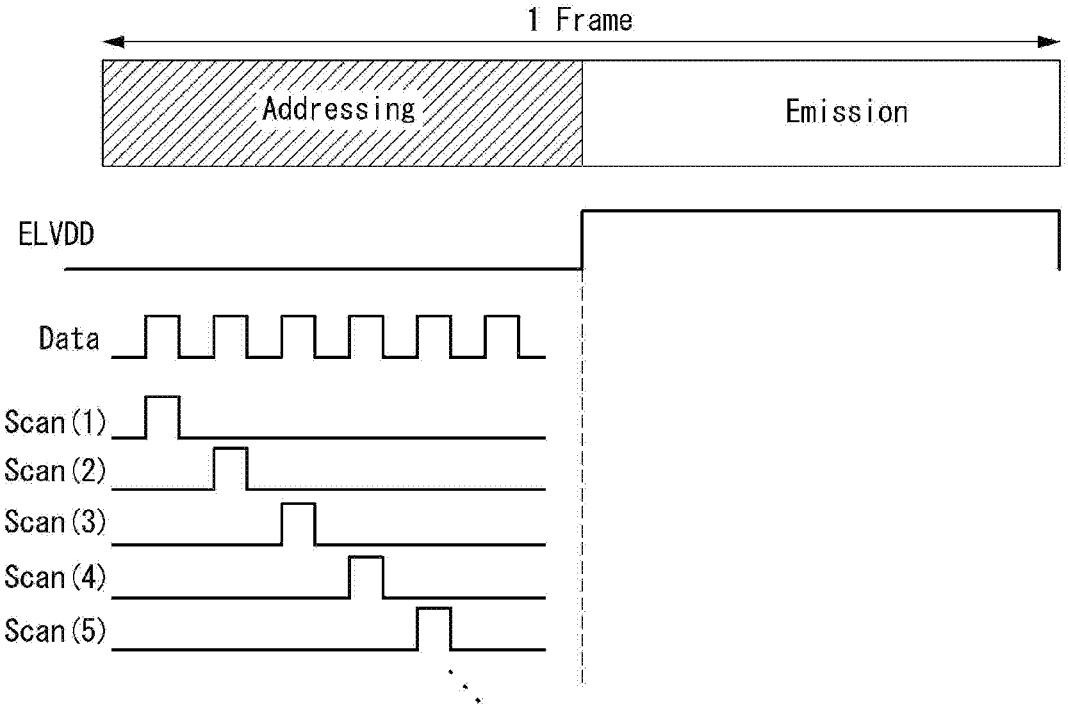
FIG. 2 is a diagram conceptually showing driving of a display panel including the pixel circuit of FIG. 1, with a global shutter method according to one embodiment.

An organic light-emitting display device employed in a virtual reality device or augmented reality device uses a 3T1C-structure pixel circuit composed of three transistors and one capacitor as shown in FIG. 1. The organic light-emitting display device may drive the pixel circuit of FIG. 1 with a global shutter method in which data is written into pixels sequentially and then all the pixels simultaneously emit light, as shown in FIG. 2.

The global shutter method may simplify the pixel structure, and may reduce the number of wires connected to the pixels, so that it is advantageous in securing the aperture ratio. In addition, in the global shutter method, the same light-emission signals are used for all the pixels or the light-emission signals are not required, so that there is no need to add a light-emission block for generating a light-emission signal separately from a scan block for generating a scan signal, resulting in a reduction in bezel size. Accordingly, the global shutter method is advantageous to a VR device.

The pixel circuit of FIG. 1 may include a driving transistor DT, a first switching transistor ST1, a second switching transistor ST2, a capacitor Cst, and an organic light-emitting diode (OLED).

The first switching transistor ST1 applies a data voltage Vdata of a data line to a gate electrode of the driving transistor DT in response to a scan signal Scan(n). The second switching transistor ST2 supplies a reference voltage Vref to a second electrode, for example, a drain electrode, of the driving transistor DT in response to a scan signal Scan(n).

A first electrode, for example, a source electrode, of the driving transistor DT is connected to a first power line through which a high-potential driving voltage Vdd is supplied. An anode electrode of an OLED is connected to the second electrode of the driving transistor DT. A cathode electrode of the OLED is connected to a second power line through which a low-potential driving voltage Vss is supplied.

The capacitor Cst is connected between the gate electrode and the second electrode of the driving transistor DT, and stores the data voltage Vdata supplied through the first switching transistor ST1.

In the global shutter method of FIG. 2, one frame may be divided into a scan period (addressing) and a light-emission period (emission). For the first power line ELVDD, the high-potential driving voltage is not supplied during the scan period, but the high-potential driving voltage is supplied only during the light-emission period.

During the scan period, being synchronized with a data signal output at intervals of one horizontal period 1H, a scan signal Scan is supplied to horizontal lines sequentially, starting from a first horizontal line to the last horizontal line, so that a data voltage is supplied to each pixel. The data voltage supplied to the pixel is stored in the capacitor Cst during the scan period and thus the level is maintained.

In the light-emission period, the high-potential driving voltage is supplied to the first power line ELVDD, so that at every pixel, the driving transistor DT is turned on and a driving current corresponding to the data voltage stored in the capacitor Cst flows through the driving transistor DT and into the OLED, and at the same time, the OLED emits light.

However, in FIG. 2, when the scan period and the light-emission period are in a 1:1 ratio, the scan period and the light-emission period are half of one frame each, so that the time taken to write data and the time taken for the OLED to emit light are reduced. When the panel has high resolution, there is a limit in further reducing the period of data writing, and the light-emission period is shortened, making it difficult to emit light with high luminance.

In the meantime, a cathode-ray tube (CRT) display device uses a vacuum tube that contains one or more electron guns and a fluorescent screen. Electrons emitted from electron guns collide with a fluorescent surface and thus generate light, thereby displaying an image. In the cathode-ray tube display device, the scan operation in which data corresponding to an image is written and the light-emission operation in which light is emitted are performed simultaneously. Therefore, constraints of time for data writing and light-emission periods are small, compared to the global shutter method.

In addition, the cathode-ray tube is impulse-driven. That is, electrons non-continuously emitted from the electron guns for a short time are separated from each other temporally and spatially, and apply the electrical impulse to another point of the fluorescent surface so that the point emits light. As described above, the electrons emitted for a very fast and short time excite the fluorescent material and light is emitted, so the response rate is greatly fast and there is almost no motion blur.

When the impulse driving of the cathode-ray tube having such an advantage is applied to an organic light-emitting display device so as to simultaneously perform the scan operation and the light-emission operation, the time taken to drive one horizontal line is secured sufficiently, whereby the frame rate may be increased and the response rate may also be increased.

Figure 3:
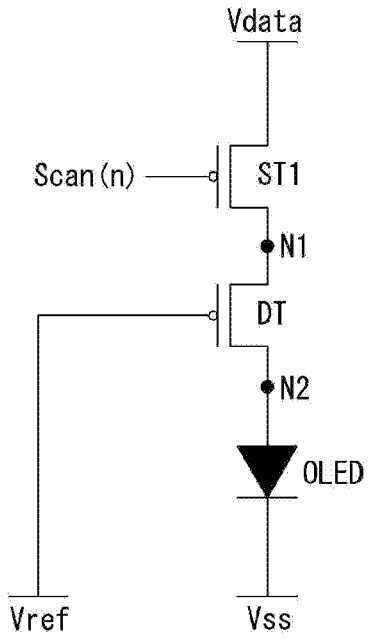
FIG. 3 is a diagram showing impulse-type driving of an OLED pixel circuit according to one embodiment.
Figure 4:
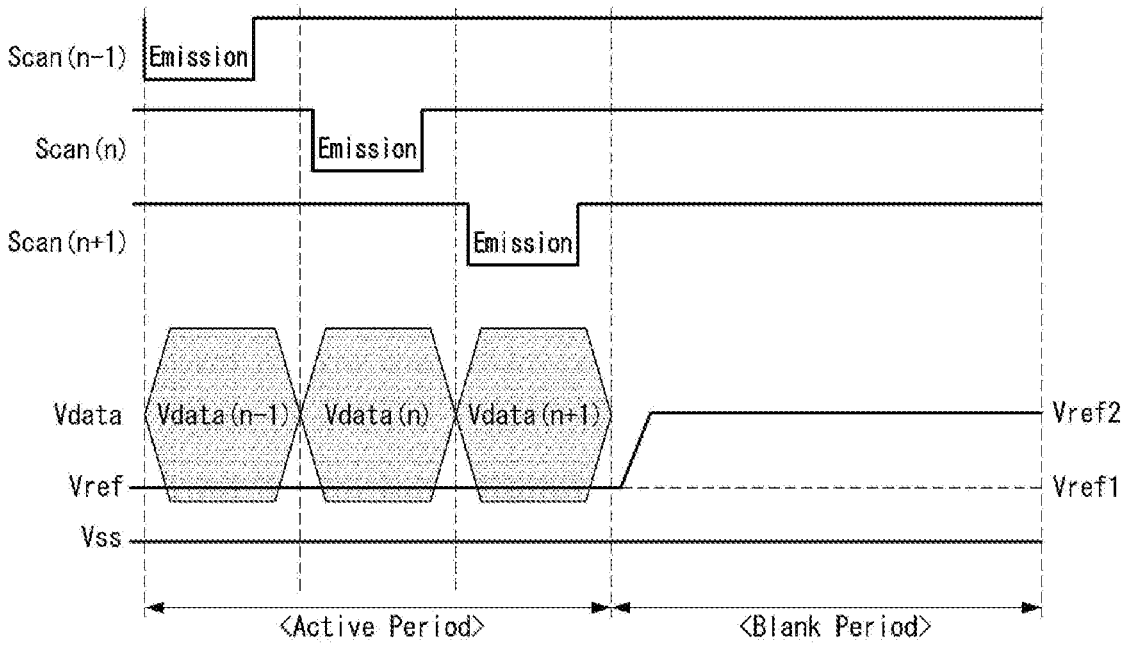
FIG. 4 is a diagram showing signals for driving the pixel circuit of FIG. 3 according to one embodiment.

FIG. 3 is a diagram showing impulse-type driving of an OLED pixel circuit. FIG. 4 is a diagram showing signals for driving the pixel circuit of FIG. 3.

The pixel circuit of FIG. 3 may include a driving transistor DT, a first switching transistor ST1, and an organic light-emitting diode (OLED).

The first switching transistor ST1 connects a data line and the driving transistor DT in response to a scan signal Scan(n). A gate electrode of the first switching transistor ST1 is connected to a gate line (or scan line) and thus receives the scan signal Scan(n). A first electrode, for example, a source electrode, of the first switching transistor ST1 is connected to the data line and thus receives a data voltage Vdata. A second electrode, for example, a drain electrode, of the first switching transistor ST1 is connected to a first electrode, for example, a source electrode, of the driving transistor DT.

The driving transistor DT generates a driving current corresponding to the data voltage Vdata and supplies the driving current to the OLED. A gate electrode of the driving transistor DT is connected to a reference line and thus receives a reference voltage Vref. The first electrode of the driving transistor DT is connected to the second electrode of the first switching transistor ST1, so that a first node N1 is formed. A second electrode, for example, a drain electrode, of the driving transistor DT is connected to an anode electrode of the OLED, so that a second node N2 is formed.

The anode electrode of the OLED is connected to the second node N2 and a cathode electrode of the OLED is connected to a low-potential power line, so that a low-potential driving voltage Vss is received.

In the pixel circuit of FIG. 3, the gate electrode of the driving transistor DT is fixed to have the reference voltage Vref, and during one horizontal period, a data voltage corresponding to a grayscale to be displayed is applied to the first electrode, namely, the source electrode, of the driving transistor DT, so that the driving transistor DT is immediately turned on and the driving current flows into the OLED, whereby the OLED emits light. That is, the pixel circuit may be driven with the impulse driving method where at intervals of one horizontal period, the data voltage is supplied and the OLED emits light, simultaneously.

In FIG. 4, one frame may be composed of an active period and a blank period. The active period corresponds to an operation period in which light is emitted while a data voltage is applied to a pixel on a per-horizontal-line basis sequentially. The blank period corresponds to a rest period for proceeding to the subsequent frame, which may be set much shorter than the active period.

In the active period, the pixels emit light, while data is applied at intervals of one horizontal period on a per-horizontal-line basis, starting from a first horizontal line to the last horizontal line. FIG. 4 simply shows an example where image data is supplied to pixels of three horizontal lines, starting from an (n−1)th horizontal line to an (n+1)th horizontal line, and light is emitted.

In an (n−1)th horizontal period, an (n−1)th scan signal Scan(n−1) is supplied to the pixels arranged in the (n−1)th horizontal line through the gate line and an (n−1)th data voltage Vdata(n−1) is supplied through the data line, so that the pixels emit light.

Afterward, in an n-th horizontal period, an n-th scan signal Scan(n) is supplied to the pixels arranged in an n-th horizontal line through the gate line and an n-th data voltage Vdata(n) is supplied through the data line, so that the pixels emit light.

In addition, in an (n+1) horizontal period, an (n+1)th scan signal Scan(n+1) is supplied to the pixels arranged in an (n+1) horizontal line through the gate line and an (n+1)th data voltage Vdata(n+1) is supplied through the data line, so that the pixels emit light.

In the blank period, the reference voltage Vref supplied to the reference line is increased from a first reference voltage Vref1 to a second reference voltage Vref2 and the second reference voltage Vref2 is supplied to the gate terminals of all the driving transistors DTs included in all pixels, so that the driving transistors DTs are definitely kept in the turn-off state, whereby the driving current does not flow into the OLED and the OLED does not emit light.

Figure 5:
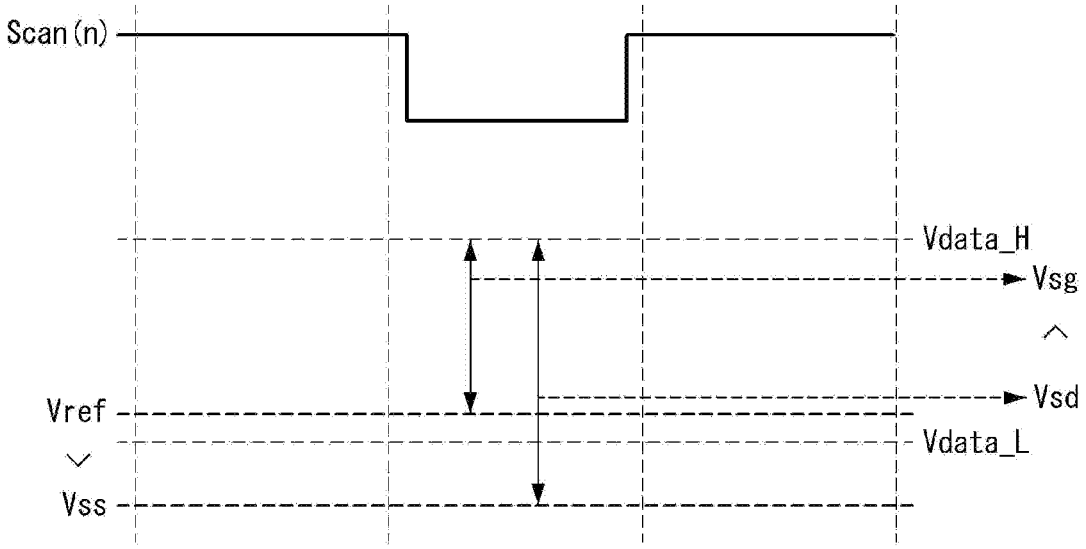
FIG. 5 is a diagram showing levels of the signals applied to the pixel circuit of FIG. 3 according to one embodiment.

FIG. 5 is a diagram showing levels of signals applied to the pixel circuit of FIG. 3.

In the pixel circuit of FIG. 3, according to a relationship between the voltages applied to the gate electrode and the second electrode, namely, the drain electrode of the driving transistor DT, an operation region of the driving transistor DT may be determined.

An ideal situation is assumed except a threshold voltage of the driving transistor DT. When the reference voltage Vref applied to the gate electrode of the driving transistor DT is set higher than the low-potential driving voltage Vss applied to the drain electrode, a potential difference Vsd between the source electrode and the drain electrode of the driving transistor DT is always greater than a potential difference Vsg between the source electrode and the gate electrode, so that the driving transistor DT operates in a saturation region.

Since the same reference voltage Vref is supplied to the gate electrodes of the driving transistors DTs of all the pixels, a range of the reference voltage Vref to be supplied to the gate electrode, in particular, the lower limit value is determined, considering the distribution of threshold voltages of the driving transistors DTs included in the pixels. In addition, the threshold voltages of the driving transistors DTs are mostly distributed near the average value Ave(Vth), and reflecting this, the reference voltage Vref may be determined to satisfy the condition Vref−Ave(Vth)>Vss.

Herein, the threshold voltage is the voltage of the gate electrode required to turn on the transistor and is determined as a negative value in a P-type MOSFET, so it is common to be represented as Vref+Ave(Vth)>Vss. However, in order to intuitively grasp the movement direction of potential to be applied to the gate electrode from the expression, the threshold voltage is regarded as a positive value and the direction thereof is represented as a minus sign.

In the meantime, the turn-on condition of the driving transistor DT is that the source-gate voltage Vsg is greater than the source-drain voltage Vsd, so that there is almost no constraint on the voltage (source voltage) applied to the source electrode of the driving transistor DT. However, the OLED emits light when the current flows from the source electrode of the driving transistor DT to the drain electrode, so the data voltage applied to the source electrode needs to be higher than the low-potential driving voltage Vss applied to the drain electrode.

In addition, the brightness of light emitted by the OLED needs to be adjusted by using the source voltage applied to the source electrode of the driving transistor DT and the pixel needs to display all the grayscales between the lowest grayscale and the highest grayscale, so a first data voltage Vdata_L for outputting the lowest grayscale and a second data voltage Vdata_H for outputting the highest grayscale need to be determined.

The current flowing in the driving transistor DT is somewhat proportional to the source-drain voltage Vsd in the saturation region of the driving transistor DT, so that the second data voltage Vdata_H needs to be higher than the first data voltage Vdata_L. That is, the data voltage operates in a gamma method.

Therefore, when the second data voltage Vdata_H at a high voltage level is applied to the source electrode of the driving transistor DT, the source-gate voltage Vsg and the source-drain voltage Vsd increase and the amount of current thus increases. Accordingly, the OLED emits light with high luminance so that the highest grayscale is displayed. In addition, when the first data voltage Vdata_L at a low voltage level is applied to the source electrode the driving transistor DT, the source-gate voltage Vsg and the source-drain voltage Vsd decrease and the amount of current thus decreases. Accordingly, the OLED emits light with low luminance so that the lowest grayscale is displayed.

In addition, the voltage of the source electrode needs to be higher than the voltage of the drain electrode in order for the current to flow from the source electrode to the drain electrode of the driving transistor DT, so the first data voltage Vdata_L for outputting the lowest grayscale needs to be higher than the low-potential driving voltage Vss applied to the drain electrode.

In the pixel circuit of FIG. 3, the driving transistor DT and the first switching transistor ST1 are implemented as P-type MOSFETs. By reflecting this, the levels of the signals in FIGS. 4 and 5 are determined. If the transistor of FIG. 3 is implemented as an N-type, the levels of the signals in FIGS. 4 and 5 may be changed accordingly.

Figure 6:
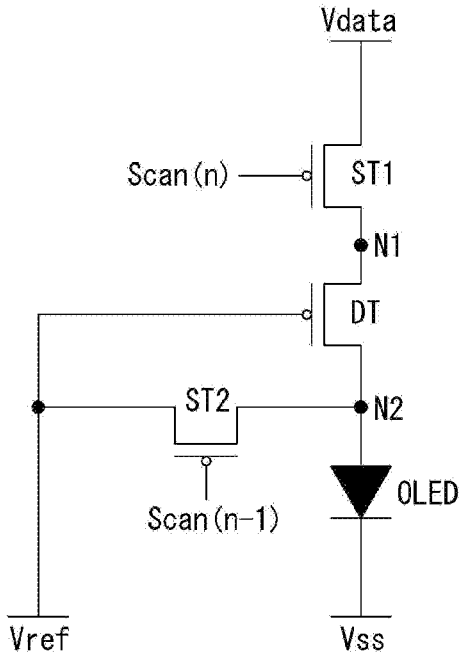
FIG. 6 is a diagram showing an OLED pixel circuit that is a modification of the pixel circuit of FIG. 3 according to one embodiment.

FIG. 6 is a diagram showing an OLED pixel circuit that is a modification of the pixel circuit of FIG. 3.

Compared to the pixel circuit of FIG. 3, the pixel circuit of FIG. 6 further includes a second switching transistor ST2 that supplies the reference voltage Vref to the second electrode of the driving transistor DT. A gate electrode of the second switching transistor ST2 is connected to a gate line through which a scan signal is supplied to the pixels of the previous horizontal line and thus receives the scan signal Scan(n−1) for causing the pixels of the previous horizontal line to emit light. Either a first or a second electrode of second switching transistor ST2 is connected to the reference line and thus receives the reference voltage Vref, and the other is connected to the anode electrode of the OLED.

The second switching transistor ST2 of the pixel of an n-th horizontal line is turned on in response to a scan signal Scan(n−1) for causing a data voltage to be applied to pixels in an (n−1)th horizontal line in a horizontal period when the pixels in the (n−1)th horizontal line emit light, so that the anode electrode of the OLED is initialized with the reference voltage Vref of the reference line.

After impulse emission at the previous frame, due to the voltage remaining in the anode electrode of the OLED, the image at the previous frame may be displayed as the afterimage at the beginning of emission for the subsequent frame. However, by initializing the anode electrode of the OLED with the reference voltage Vref before emission at the frame, the afterimage unrelated to the grayscale to be displayed is prevented from being displayed.

Figure 7:
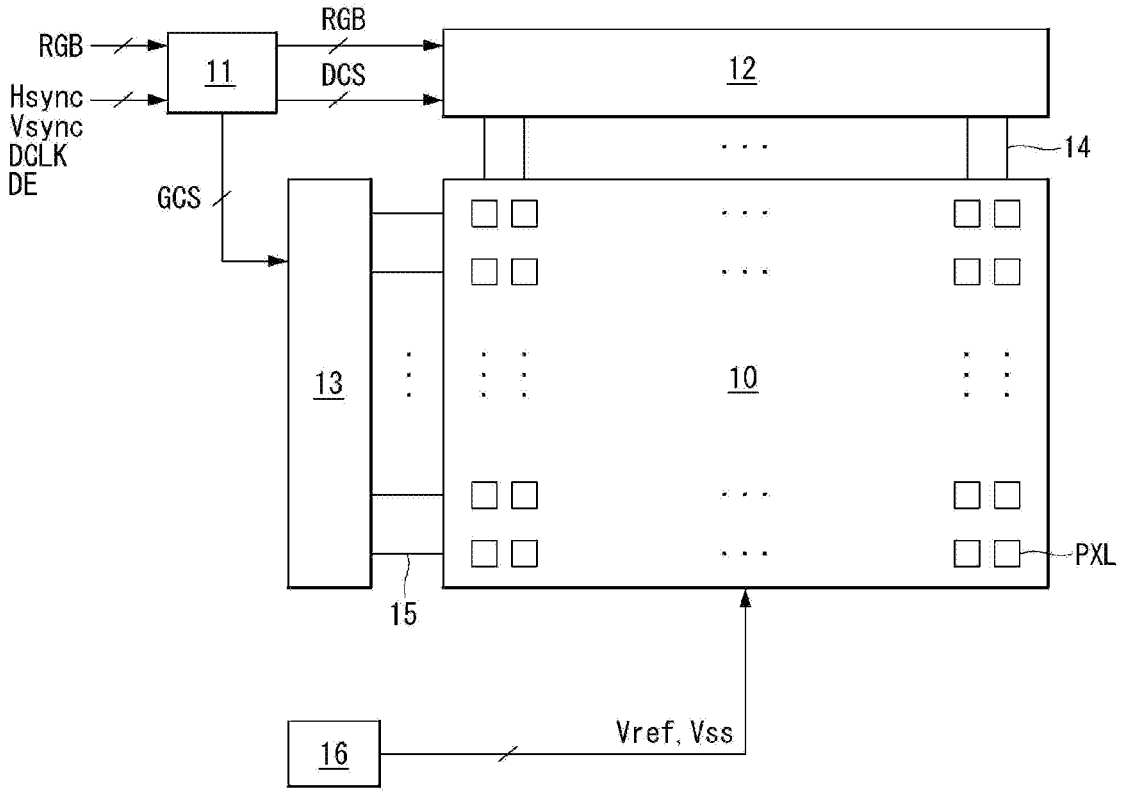
FIG. 7 is a block diagram showing an organic light-emitting display device according to one embodiment.

FIG. 7 is a block diagram showing an organic light-emitting display device. The display device of FIG. 7 may include a display panel 10, a timing controller 11, a data driving circuit 12, a gate driving circuit 13, and a power generator 16.

In the display panel 10, multiple data lines 14 arranged in the column direction (or vertical direction) and multiple gate lines 15 arranged in the row direction (or horizontal direction) intersect, and pixels PXLs at respective intersection regions are arranged in a matrix form so that a pixel array is formed. A scan signal for causing a data voltage supplied to the data line 14, to be applied to the pixels is supplied to the gate lines 15.

In the pixel array, the pixels PXLs arranged in the same horizontal line access any one of the data lines 14 and any one of the gate lines 15 so that a pixel line is formed. The pixel is electrically connected to the data line 14 in response to the scan signal applied through the gate line 15, and receives the data voltage. The pixels PXLs arranged in the same pixel line may simultaneously operate according to the scan signal applied from the same gate line 15. Each pixel PXL drives the OLED with a current proportional to the applied data voltage.

One-pixel unit may be composed of three subpixels including a red subpixel, a green subpixel, and a blue subpixel, or four sub-pixels including a red subpixel, a green subpixel, a blue subpixel, and a white subpixel, but this is not limited thereto.

The pixel PXL may receive the reference voltage Vref and the low-potential driving voltage Vss from the power generator 16, and may include, as shown in FIG. 3, the first switching transistor ST1, the driving transistor DT, and the OLED. Although in FIG. 3, an OLED is shown as a light-emitting device, the light-emitting device may be replaced with an inorganic electroluminescence device. Hereinafter, for convenience of description, an OLED will be described as an example.

A driving transistor and switching transistors constituting a pixel may be implemented in a structure of a P-type or N-type metal-oxide-semiconductor field-effect transistor (MOSFET), or may be implemented as a hybrid type in which the P-type and the N-type are combined. This specification describes a P-type transistor as an example, but is not limited thereto.

A transistor is a three-electrode device including gate, source, and drain. The source is an electrode that supplies carriers to the transistor. Within the transistor, carriers start flowing from the source. The drain is an electrode from which the carries flow out of the transistor. That is, in the MOSFET, the carriers flow from the source to the drain.

In the case of a P-type MOSFET (PMOS), since carriers are holes, the source voltage is higher than the drain voltage so that the holes flow from the source to the drain. In the P-type MOSFET, since the holes flow from the source toward the drain, the current flows from the source toward the drain. In the case of an N-type MOSFET (NMOS), since the carriers are electrons, the source voltage is lower than the drain voltage so that the electrons flow from the source to the drain. In the N-type MOSFET, since the electrons flow from the source toward the drain, the current flows from the drain toward the source.

It is noted that the source and the drain of the MOSFET are not fixed. For example, the source and the drain of the MOSFET may vary according to the applied voltage. In the following embodiment, the disclosure should not be limited due to the source and the drain of the transistor, and the source electrode and the drain electrode may also be referred to as a first electrode and a second electrode without being divided.

The timing controller 11 supplies image data (RGB) transmitted from an external host system (not shown), to the data driving circuit 12. The timing controller 11 receives a timing signal such as a vertical synchronization signal Vsync, a horizontal synchronization signal Hsync, a data enable signal DE, a dot clock DCLK, and the like from the host system, and generates control signals for controlling operation timing of the data driving circuit 12 and the gate driving circuit 13. The control signals include a gate timing control signal GCS for controlling operation timing of the gate driving circuit 13, and a data timing control signal DCS for controlling operation timing of the data driving circuit 12.

The timing controller 11 may drive by dividing one frame, in which image data for one screen is applied to the pixels constituting the display panel 10, into an active period and a blank period. The active period is a period in which light is emitted while data is applied to the pixels on a per-horizontal line basis sequentially, starting from a first horizontal line to the last horizontal line, and the blank period is a period in which the gate electrodes of the driving transistors DTs included in all the pixels are initialized with the second reference voltage Vref2.

Under control by the timing controller 11, the data driving circuit 12 performs sampling and latch operation on digital video data (RGB) input from the timing controller 11, converts the digital video data into parallel data, converts the resulting data into an analog data voltage according to a gamma reference voltage, and outputs the result to the data lines 14 through an output channel. The data voltage may be a value corresponding to the grayscale to be displayed by a pixel. The data driving circuit 12 may be composed of multiple source driver ICs.

Under control by the timing controller 11, the gate driving circuit 13 generates a scan signal on the basis of a gate control signal GDC. In the active period, the gate driving circuit 13 generates scan signal in a row-sequential manner, and sequentially provides the resulting signals to the gate lines 15 connected to the respective pixel lines.

The gate driving circuit 13 may be composed of multiple gate driver ICs each including a shift register, an output buffer, a level shifter for converting an output signal of the shift register to a swing width appropriate for TFT driving of the pixel, and the like. Alternatively, the gate driving circuit 13 may be directly provided on a lower substrate of the display panel 10 in a gate-driver-IC-in-panel (GIP) manner. In the case of the GIP manner, the level shifter is mounted on a printed circuit board (PCB) and the shift register may be provided on the lower substrate of the display panel 10.

The power generator 16 may generate and supply, by using an external power source, a voltage required for operation of the data driving circuit 12 and the gate driving circuit 13, and may generate the reference voltage Vref and the low-potential driving voltage Vss for application to the display panel 10. In the active period, the power generator 16 may output the first reference voltage Vref1 as the reference voltage Vref. In the blank period, the power generator 16 may output, as the reference voltage Vref, the second reference voltage Vref2 at a level (the level is farther from the low-potential driving voltage Vss than the first reference voltage Vref1 is) higher than the first reference voltage Vref1.

The power generator 16 generates and outputs the reference voltage Vref at the level higher than the low-potential driving voltage Vss. In particular, the power generator 16 generates the reference voltage Vref so that a value obtained by adding the first reference voltage Vref1 and the average value of the threshold voltages of the pixels is higher than the low-potential driving voltage Vss.

Figure 8:
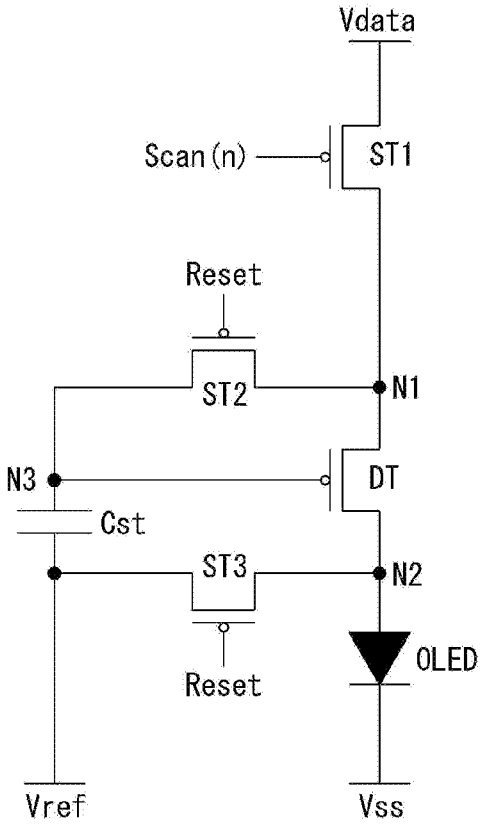
FIG. 8 is a diagram showing an OLED pixel circuit capable of impulse-type driving while compensating for a threshold voltage according to one embodiment.
Figure 9:
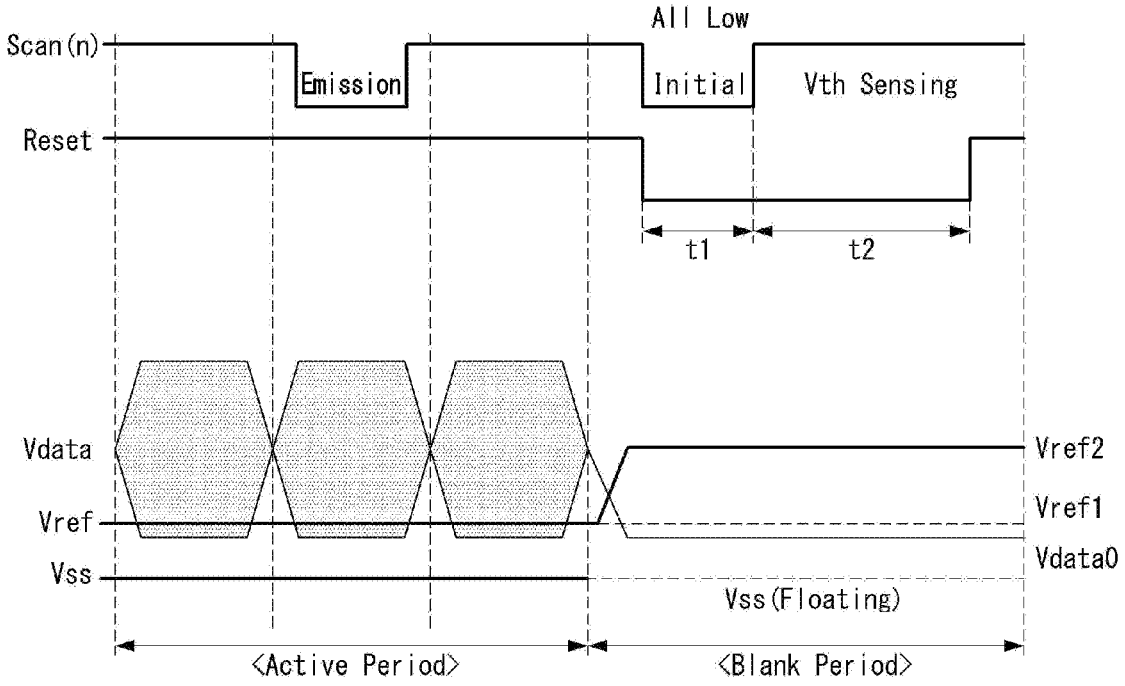
FIG. 9 is a diagram showing a signal for driving the pixel circuit of FIG. 8 according to one embodiment.
Figure 10A:
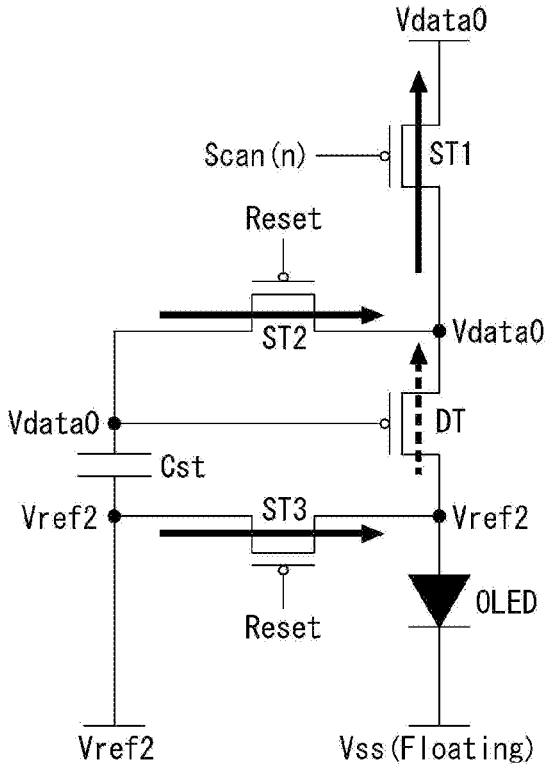
FIGS. 10A to 10C are diagrams showing operations of the OLED pixel circuit of FIG. 8 for steps of the signal of FIG. 9, respectively according to one embodiment.
Figure 10B:
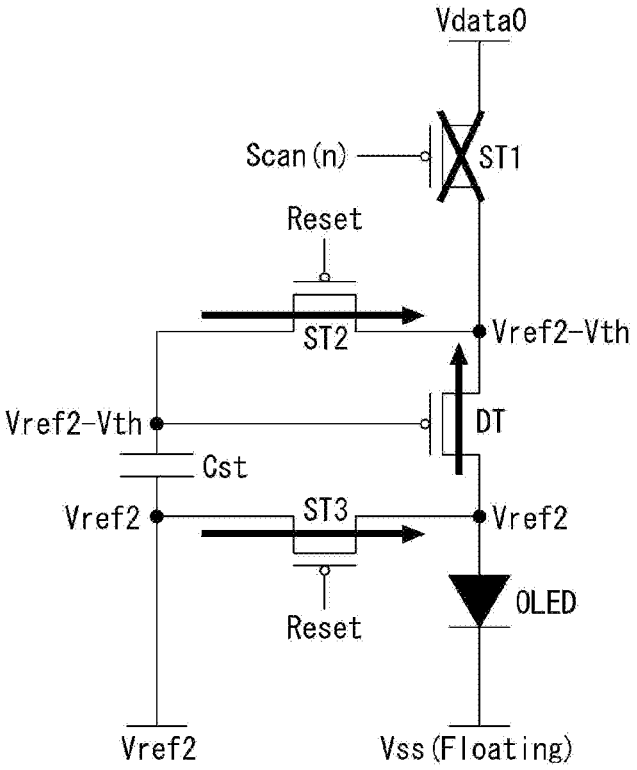
Figure 10C:
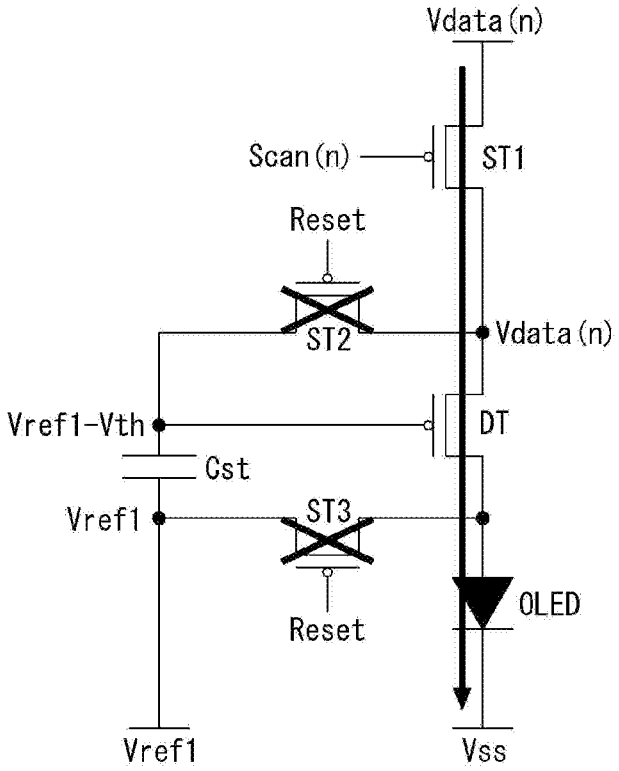

FIG. 8 is a diagram showing an OLED pixel circuit capable of impulse-type driving while compensating for a threshold voltage. FIG. 9 is a diagram showing a signal for driving the pixel circuit of FIG. 8. FIGS. 10A to 10C are diagrams showing operations of the pixel circuit of FIG. 8 for steps of the signal of FIG. 9, respectively.

The pixel circuit of FIG. 8 may include a driving transistor DT, a first to a third switching transistor ST1, ST2, and ST3, a storage capacitor Cst, and an organic light-emitting diode (OLED).

The first switching transistor ST1 connects a data line and the driving transistor DT in response to a scan signal Scan(n). A gate electrode of the first switching transistor ST1 is connected to a scan line and thus receives the scan signal Scan(n). Either a first electrode or a second electrode of the first switching transistor ST1 is connected to the data line and thus receives a data voltage Vdata, and the other is connected to a first electrode, for example, a source electrode of the driving transistor DT, and thus a first node N1 is formed.

The second switching transistor ST2 connects the first electrode and a gate electrode of the driving transistor DT in response to a reset signal Reset. The gate electrode of the second switching transistor ST2 is connected to a reset line and thus receives the reset signal Reset. Either a first electrode or a second electrode of the second switching transistor ST2 is connected to the first electrode of the driving transistor DT, and the other is connected to the gate electrode of the driving transistor DT.

The driving transistor DT generates a driving current corresponding to the data voltage Vdata and supplies the driving current to the OLED. The first electrode, for example, the source electrode, of the driving transistor DT is connected to the second electrode of the first switching transistor ST1, that is, the first node N1 and thus receives the data voltage Vdata. The second electrode, for example, a drain electrode, of the driving transistor DT is connected to an anode electrode of the OLED, so that a second node N2 is formed. The gate electrode of the driving transistor DT is connected to a third node N3.

The third switching transistor ST3 supplies a reference voltage Vref to the second electrode of the driving transistor DT in response to the reset signal Reset. A gate electrode of the third switching transistor ST3 is connected to a reset line and thus receives the reset signal Reset. Either a first electrode or a second electrode of the third switching transistor ST3 is connected to the second electrode of the driving transistor DT, and the other is connected to a reference line and thus receives the reference voltage Vref.

The storage capacitor Cst is connected between the gate electrode of the driving transistor DT (or the third node N3) and a reference line input terminal.

In the OLED that emits light according to the driving current generated by the driving transistor DT, an anode electrode is connected to the second electrode of the driving transistor DT (or the second node N2), and a cathode electrode is connected to a low-potential power line, so that the low-potential driving voltage Vss is received.

Similarly to the pixel circuit of FIG. 3, the pixel circuit of FIG. 8 may be driven by using the impulse driving method where at intervals of one horizontal period, the data voltage is supplied and the pixel emits light, simultaneously. That is, the gate electrode of the driving transistor DT is connected to the reference line via the storage capacitor Cst and is thus fixed to have the voltage near the reference voltage Vref, and during one horizontal period, a data voltage corresponding to a grayscale to be displayed is applied to the first electrode, namely, the source electrode, of the driving transistor DT, so that the driving transistor DT is immediately turned on and the driving current flows into the OLED, whereby the OLED emits light.

In FIG. 9, one frame may be composed of an active period and a blank period. The active period corresponds to an operation period in which light is emitted while a data voltage is applied to a pixel on a per-horizontal-line basis sequentially. The blank period corresponds to a sensing period in which the threshold voltages of the driving transistor DTs included in all the pixels are simultaneously sensed, which may be set much shorter than the active period.

In the active period, on a sequential per-horizontal-line basis, starting from a first horizontal line to the last horizontal line, a scan signal having a turn-on level of one horizontal period is applied, so that data is applied to the pixels in the corresponding horizontal line and the pixels thus emit light.

In the active period, the data voltage Vdata is supplied to the data line, the first reference voltage Vref1 is supplied to the reference line as the reference voltage Vref, and the low-potential driving voltage Vss is supplied to the low-potential power line.

In the blank period, the scan signal and the reset signal are input to all the pixels identically, so that all the pixels perform the same operation. First, during a first period t1, a scan signal Scan and a reset signal Reset at a turn-on level are applied, so that the pixels are initialized. During a second period t2, the level of the scan signal is switched to a turn-off level and the level of the reset signal Reset is kept at the turn-on level, so that the threshold voltages of the driving transistor DTs included in the pixels are sensed.

In the first period t1 of the blank period, the gate driving circuit 13 simultaneously outputs the scan signal at the turn-on level to all the gate lines. In the first period t1 and the second period t2 of the blank period, the gate driving circuit 13 outputs the reset signal at the turn-on level to the reset line connected to all the pixels in common.

In the blank period, power is not supplied to the low-potential power line and a floating state occurs, so that no current flows into the OLED. In addition, the second reference voltage Vref2 is supplied to the reference line as the reference voltage Vref, and a data voltage Vdata0 at a predetermined level is supplied to all the data lines.

Herein, the second reference voltage Vref2 supplied to the reference line is at a level higher than the first reference voltage Vref1 supplied in the active period, and is at a level also higher than the data voltage Vdata0 supplied to the data line in the blank period.

FIG. 10A is a diagram showing an operation of the pixel circuit during the first period t1 of the blank period, and the first period t1 corresponds to an initialization period in which the anode electrode of the OLED is initialized.

In the first period t1, the scan signal at the turn-on level and the reset signal Reset at the turn-on level are applied, so that the first switching transistor ST1, the second switching transistor ST2, and the third switching transistor ST3 are turned on.

Since the first switching transistor ST1 is turned on, the data line is connected to the first electrode of the driving transistor and the voltage of the first electrode (first node N1) of the driving transistor DT reaches the data voltage Vdata0 at the predetermined level.

In addition, since the second switching transistor ST2 is turned on, the gate electrode and the first electrode of the driving transistor DT are connected to each other and the voltage of the gate electrode (third node N3) of the driving transistor DT reaches the data voltage Vdata0 at the predetermined level.

In addition, since the third switching transistor ST3 is turned on, the second electrode of the driving transistor DT is connected to the reference line and the voltage of the second electrode (second node N2) of the driving transistor DT is initialized to the second reference voltage Vref2.

FIG. 10B is a diagram showing the operation of the pixel circuit during the second period t2 of the blank period, and the second period t2 corresponds to a sensing period in which the threshold voltage of the driving transistor DT is sensed and is stored in the storage capacitor Cst.

In the second period t2, the scan signal at the turn-off level and the reset signal Reset at the turn-on level are applied, so that the first switching transistor ST1 is turned off and the second switching transistor ST2 and the third switching transistor ST3 are turned on.

Since the first switching transistor ST1 is turned off and the second switching transistor ST2 is kept in the turn-on state, the connection between the first electrode of the driving transistor DT and the data line is broken and the first electrode and the gate electrode of the driving transistor DT are connected to each other, so that the driving transistor DT is diode-connected. In addition, the third switching transistor ST3 is kept in the turn-on state and the voltage of the second electrode of the driving transistor DT is kept at the second reference voltage Vref2.

The second reference voltage Vref2 of the second electrode of the driving transistor DT is higher than the data voltage Vdata0 of the first electrode of the driving transistor DT that is diode-connected. Therefore, the current flows from the second electrode to the first electrode of the driving transistor DT, and the potential of the first electrode (and the gate electrode) increases and thus reaches a value (Vref2−Vth) that is lower than the second reference voltage Vref2 which is the potential of the second electrode, by the threshold voltage Vth.

Accordingly, threshold voltage Vth of the driving transistor DT is sensed and the threshold voltage Vth is stored in the storage capacitor Cst.

FIG. 10C is a diagram showing an operation of the pixels arranged in the n-th horizontal line in the active period, which corresponds to a period in which the data voltage Vdata(n) is applied and the OLED emits light accordingly.

The scan signal Scan(n) at the turn-on level and the reset signal Reset at the turn-off level are applied, so that the first switching transistor ST1 is turned on and the second switching transistor ST2 and the third switching transistor ST3 are turned off.

Since the first switching transistor ST1 is turned on, the data line is connected to the first electrode of the driving transistor DT and the first electrode of the driving transistor DT is charged with the data voltage Vdata(n).

Since the second switching transistor ST2 and the third switching transistor ST3 are turned off, the gate electrode of the driving transistor DT is connected to the reference line via the storage capacitor Cst and the storage capacitor Cst stores the threshold voltage Vth, so that the gate electrode of the driving transistor DT is charged with a value (Vref1−Vth) obtained by subtracting the threshold voltage Vth from the first reference voltage Vref1.

Since the potential (Vref1−Vth) of the gate electrode of the driving transistor DT is higher than the low-potential driving voltage Vss that is the potential of the second node N2, which is the drain electrode, the source-gate voltage Vsg is greater than the source-drain voltage Vsd, so that the driving transistor DT is turned on and operates in the saturation region.

The current I_OLED flowing in the driving transistor DT in the saturation region is proportional to the square of a value obtained by subtracting the threshold voltage Vth from the source-gate voltage Vsg, and this is represented as in Equation 1 below.

$$\text{I_OLED} \propto (Vsg - Vth)^2 = (Vdata(n) - (Vref1 - Vth) - Vth)^2 = (Vdata(n) - Vref1)^2 \quad \text{[Equation 1]}$$

As shown in Equation 1, in the relation equation of the driving current I_OLED, the threshold voltage Vth component of the driving transistor DT is eliminated. Therefore, even if the threshold voltage of the driving transistor DT changes, while compensating for the threshold voltage, the OLED emits light with the current corresponding to the data voltage Vdata(n) input through the data line.

Figure 11A:
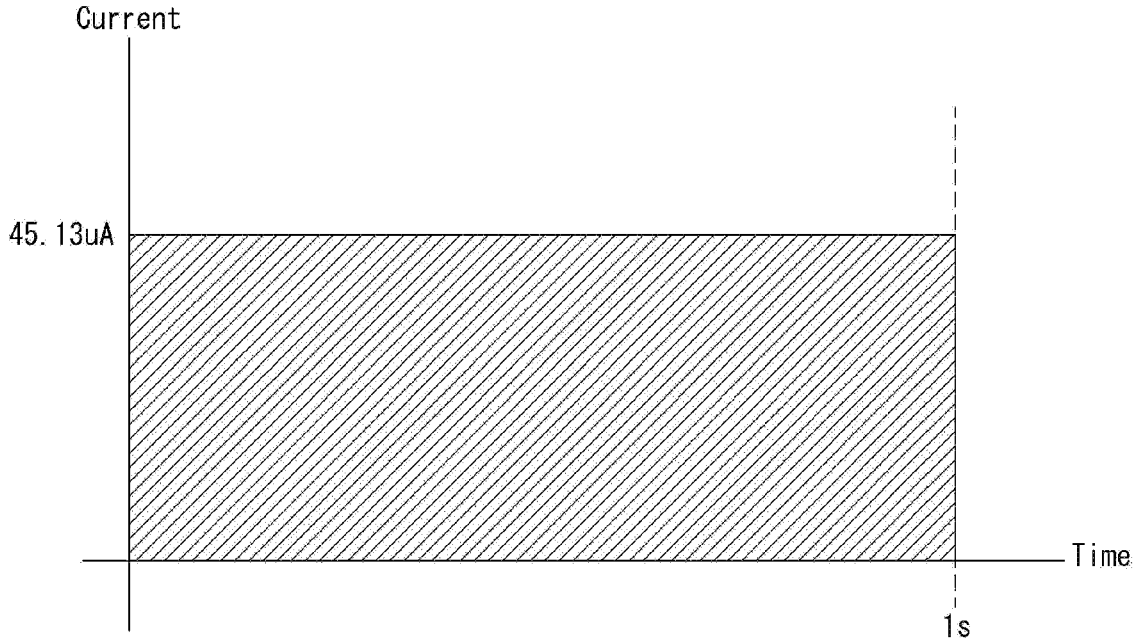
FIGS. 11A and 11B are graphs showing the sizes of the current flowing during one horizontal period in the pixel circuit of FIG. 1 and the pixel circuit of FIG. 4, respectively according to one embodiment.
Figure 11B:
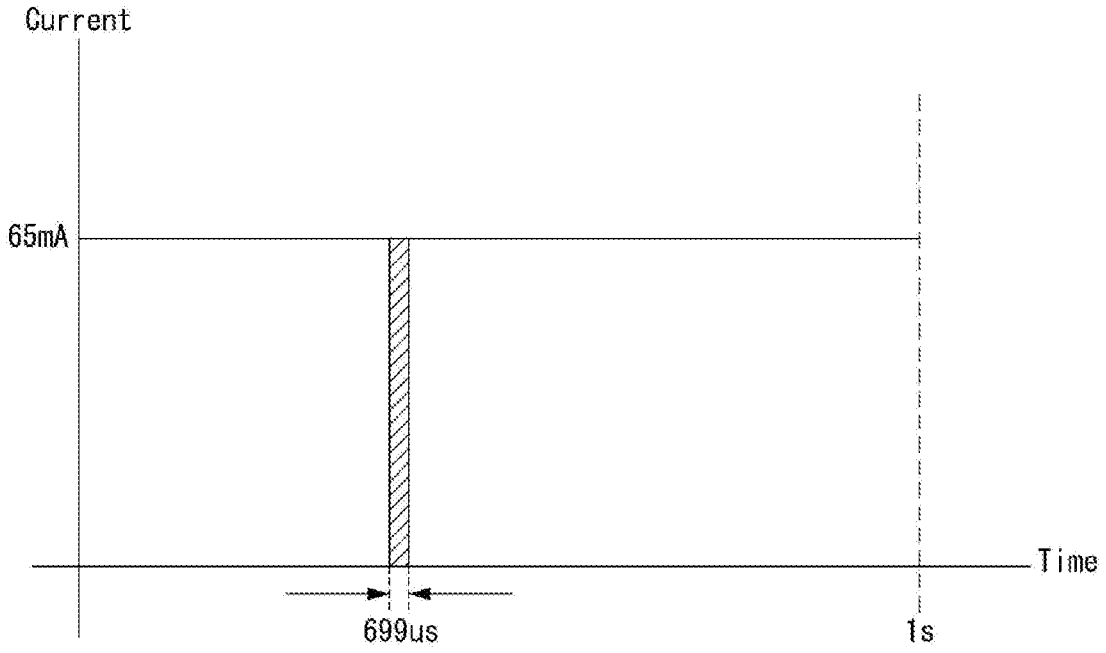

FIGS. 11A and 11B are graphs showing the sizes of the currents flowing during one horizontal period in the pixel circuit of FIG. 1 and the pixel circuit of FIG. 3, respectively.

The current flowing in the OLED and luminance according thereto are in a proportional relationship. Therefore, when pixels are arranged with the same density in the same area on the display panel and the pixels emit light with the same luminance, the power consumption is the same. That is, the power consumed when the display panel is driven by using the impulse driving method is the same as the power consumed when the display panel is driven by using another method but with the same luminance.

For example, when the pixel circuit of FIG. 1 is placed on a three-inch area with the density of 1440×1440 resolution and is driven with 150 nits by using the global shutter method of FIG. 2, the power consumption during one second is about 65 mA. Herein, since there are 1440 horizontal lines in the vertical direction, 65 mA/1440=45.13 uA continuously flows for one second in the pixels in one horizontal line, as shown in FIG. 11A.

Similarly, when the pixel circuit of FIG. 3 is placed on the same area with the same density and is driven by using the driving method of FIG. 4, 65 mA momentarily flows in one horizontal line for 1 sec/1440=699 us, as shown in FIG. 11B.

Therefore, the ability to enable the current to momentarily flow needs to be increased by 1440 times. The driving current generated by the driving transistor DT is proportional to the square of the source-gate voltage Vsg, so when the source-gate voltage Vsg is increased 11 times, the luminance from the OLED operating with the driving current is increased by 2048 times, which is two to the power of 11.

Regarding a 7T1C-structure model, when the luminance is increased from 150 nits to 300 nits, the data voltage of about 0.3 V needs to be increased. Therefore, by increasing the data voltage by 0.3 V, the luminance of 300 nits may be realized.

The display device in this specification may be may be described as follows.

According to an embodiment, there is provided a display device including: a display panel provided with multiple pixels; a driving circuit driving the display panel by supplying a scan signal to horizontal lines sequentially, starting from a first horizontal line to the last horizontal line, through multiple gate lines each connected to the pixels in each of the horizontal lines of the display panel, in synchronization with supply of a data voltage through multiple data lines; and a power generator supplying an operating voltage to the display panel.

Each of the pixels includes: a first switching transistor of which a gate electrode is connected to the gate line, of which a first electrode is connected to the data line, and of which a second electrode is connected to a first node; a driving transistor of which a gate electrode is connected to a reference line and thus receives a reference voltage supplied from the power generator, of which a first electrode is connected to the first node, and of which a second electrode is connected to a second node; and a light-emitting device of which an anode electrode is connected to the second node, and of which a cathode electrode is connected to a power line through which the power generator supplies a low-potential power supply voltage.

In an embodiment, the pixel may further include a second switching transistor of which a gate electrode is connected to the gate line through which the scan signal is supplied to a previous pixel line, and of which a first electrode and a second electrode are connected to any one among the second node and the gate electrode of the driving transistor and the other one, respectively.

In an embodiment, the reference voltage may be higher than the low-potential driving voltage in terms of potential.

In an embodiment, a sum of the reference voltage and a threshold voltage of the driving transistor may be higher than the low-potential driving voltage in terms of potential.

In an embodiment, the power generator may output a second reference voltage as the reference voltage in a blank period of one frame excluding an active period in which the scan signal is sequentially supplied. The second reference voltage may have a level that is farther from the low-potential driving voltage than a first reference voltage output as the reference voltage in the active period is.

In an embodiment, the driving circuit may apply the data voltage that is higher than the low-potential driving voltage, to the data line.

In an embodiment, the pixel may further include: a second switching transistor connecting the first node and the gate electrode of the driving transistor in response to a reset signal supplied to a reset line; a third switching transistor supplying the reference voltage to the second node in response to the reset signal; and a storage capacitor connected between the gate electrode of the driving transistor and the reference line.

In an embodiment, in a blank period of one frame excluding an active period in which the scan signal is sequentially supplied, a threshold voltage of the driving transistor may be sensed.

In an embodiment, the driving circuit may apply the scan signal at a turn-on level and the reset signal at a turn-on level to all the pixels and may thus initialize the second node with the reference voltage in a first period of the blank period, and may apply the scan signal at a turn-off level and the reset signal at the turn-on level to all the pixels and may thus store the threshold voltage of the driving transistor in the storage capacitor in a second period of the blank period after the first period.

In an embodiment, in the blank period, the power generator may cause the power line to be in a floating state and outputs, as the reference voltage, a second reference voltage having a level that is father from the low-potential driving voltage than a first reference voltage output as the reference voltage in the active period is.

In an embodiment, in the blank period, the driving circuit may supply the data voltage lower than the second reference voltage to the multiple data lines.

Accordingly, the gate electrode of the driving transistor is fixed and the data voltage is applied to the source electrode of the driving transistor by using only the scan signal, so that data voltage charging and OLED emission are simultaneously implemented by using the impulse driving method, thereby increasing the response characteristic. In addition, the pixel structure is simple and the number of control lines is reduced, thereby obtaining high resolution per unit area.

Through the above description, those skilled in the art will appreciate that various changes and modifications are possible without departing from the technical idea of the present disclosure. Therefore, the technical scope of the present disclosure is not limited to the contents of the detailed description of the specification, but is determined by the scope of the appended claims.

As described above, by simplifying the pixel structure included in the display panel, high resolution per unit area is achieved. In addition, the pixels are impulse-driven, so that the response characteristic is increased. In addition, the display panel with the increased response characteristic is applied to a VR device, thereby reducing user fatigue.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel provided with multiple pixels;

a driving circuit driving the display panel by supplying a scan signal to horizontal lines sequentially, starting from a first horizontal line to a last horizontal line, through multiple gate lines each connected to the pixels in each of the horizontal lines of the display panel, in synchronization with supply of a data voltage through multiple data lines; and a power generator supplying an operating voltage to the display panel, wherein each of the pixels includes:

a first switching transistor of which a gate electrode is connected to the gate line, of which a first electrode is connected to the data line, and of which a second electrode is connected to a first node;

a driving transistor comprising a gate electrode, a first electrode connected to a first node, and a second electrode connected to a second node, the gate electrode connected to a reference line and the gate electrode receives a reference voltage supplied from the power generator during an active period of a frame during which the pixel emits light; and a light-emitting device of which an anode electrode is connected to the second node, and of which a cathode electrode is connected to a power line through which the power generator supplies a low-potential driving voltage.

2. The display device of claim 1, wherein each of the pixels further includes:

a second switching transistor connecting the first node and the gate electrode of the driving transistor in response to a reset signal supplied to a reset line;

a third switching transistor supplying the reference voltage to the second node in response to the reset signal; and a storage capacitor connected between the gate electrode of the driving transistor and the reference line.

3. The display device of claim 2, wherein in a blank period of one frame excluding an active period in which the scan signal is sequentially supplied, a threshold voltage of the driving transistor is sensed.

4. The display device of claim 3, wherein the driving circuit applies the scan signal at a turn-on level and the reset signal at a turn-on level to all the pixels and thus initializes the second node with the reference voltage in a first period of the blank period, and applies the scan signal at a turn-off level and the reset signal at the turn-on level to all the pixels and thus stores the threshold voltage of the driving transistor in the storage capacitor in a second period of the blank period after the first period.

5. The display device of claim 4, wherein in the blank period, the power generator causes the power line to be in a floating state and outputs, as the reference voltage, a second reference voltage having a level that is father from the low-potential driving voltage than a first reference voltage output as the reference voltage in the active period is.

6. The display device of claim 5, wherein in the blank period, the driving circuit supplies the data voltage lower than the second reference voltage to the multiple data lines.

7. The display device of claim 1, wherein the reference voltage is higher than the low-potential driving voltage in terms of potential.

8. The display device of claim 7, wherein a sum of the reference voltage and a threshold voltage of the driving transistor is higher than the low-potential driving voltage in terms of potential.

9. The display device of claim 1, wherein each of the pixels further includes a second switching transistor comprising a gate electrode connected to the gate line through which the scan signal is supplied to a previous pixel line, a first electrode connected to one of the second node and the gate electrode of the driving transistor, and a second electrode connected to a remaining one of the second node and the gate electrode of the driving transistor, respectively.

10. The display device of claim 1, wherein the driving circuit applies the data voltage that is higher than the low-potential driving voltage to the data line.

11. A display device comprising:

a display panel provided with multiple pixels;

a driving circuit driving the display panel by supplying a scan signal to horizontal lines sequentially, starting from a first horizontal line to a last horizontal line, through multiple gate lines each connected to the pixels in each of the horizontal lines of the display panel, in synchronization with supply of a data voltage through multiple data lines; and a power generator supplying an operating voltage to the display panel, wherein each of the pixels includes:

a first switching transistor of which a gate electrode is connected to the gate line, of which a first electrode is connected to the data line, and of which a second electrode is connected to a first node;

a driving transistor of which a gate electrode is connected to a reference line and receives a reference voltage supplied from the power generator, of which a first electrode is connected to the first node, and of which a second electrode is connected to a second node; and a light-emitting device of which an anode electrode is connected to the second node, and of which a cathode electrode is connected to a power line through which the power generator supplies a low-potential driving voltage, wherein the power generator outputs a second reference voltage as the reference voltage in a blank period of one frame excluding an active period in which the scan signal is sequentially supplied, and the second reference voltage has a level that is farther from the low-potential driving voltage than a first reference voltage output as the reference voltage in the active period is.

* * * * *